US005415301A

United States Patent [19]

Bruton et al.

[11] Patent Number: 5,415,301

[45] Date of Patent: May 16, 1995

[54] STRUCTURAL POST MEMBER FOR MERCHANDISE DISPLAY RACK

[75] Inventors: John Bruton, Dollard des Ormeaux; Julian De Salis, Outremont, both of Canada

[73] Assignee: Knape & Vogt Canada, Inc., Etobicoke, Canada

[21] Appl. No.: 96,960

[22] Filed: Jul. 26, 1993

[51] Int. Cl.[6] ..... A47F 5/00

[52] U.S. Cl. ..... 211/183; 211/187; 52/731.2; 52/731.4; 52/731.5; 52/731.8; 52/731.9; 52/732.3

[58] Field of Search ..... 211/187, 189, 191, 183; 52/720, 730.1, 731.2, 731.4, 731.5, 731.8, 731.9, 732.3

[56] References Cited

U.S. PATENT DOCUMENTS

| | | | |
|---|---|---|---|
| 2,933,196 | 4/1960 | Childs | 211/187 X |
| 3,101,681 | 8/1963 | Streater | 211/187 X |
| 3,102,641 | 9/1963 | Konstant et al. | 211/191 |
| 3,199,471 | 10/1965 | Orsi | 211/187 X |
| 3,265,217 | 8/1966 | Biggs | 211/187 X |
| 3,312,032 | 4/1967 | Ames | 52/731.5 X |
| 3,465,895 | 9/1969 | Miller | 211/191 |
| 3,570,798 | 3/1971 | Squibb | 211/187 X |
| 3,587,867 | 6/1971 | Fenwick | 211/187 X |
| 3,602,159 | 8/1971 | Marschak | 211/187 x |
| 3,640,389 | 2/1972 | Snyder | 211/187 |
| 3,672,515 | 6/1972 | Rous | 211/191 |
| 4,064,996 | 12/1977 | Shillum | 211/191 |
| 4,067,445 | 1/1978 | Derclaye | 211/191 |

*Primary Examiner*—Blair M. Johnson
*Attorney, Agent, or Firm*—Baker & Botts

[57] ABSTRACT

Disclosed is a structural member for use as a vertical supporting post in a merchandise display rack. This member is made of two identical, longitudinally extending end plates that are W-shaped in cross-section and oriented in such a manner as to face each other, and of two identical, longitudinally extending side plates that are welded to the end plates to join the same and form the member. The end faces of the end plates are provided with three parallel rows of longitudinal slots for use to hook a footing at the bottom of the post, or one or more shelves along the same. With very slight changes only, the side plates may also be used as tie-bars for interconnecting the posts of the rack.

14 Claims, 6 Drawing Sheets

STRUCTURAL POST MEMBER FOR MERCHANDISE DISPLAY RACK

BACKGROUND OF THE INVENTION a) Field of the Invention

The present invention is concerned with an improvement to the kind of merchandise display racks known in the trade as "gondolas", which improvement essentially lies in the structure and manufacture of the posts and tie-rods acting as structural members in such racks.

b) Brief Description of the Prior Art

Gondolas are merchandise display racks that are widely used in retail stores especially food stores, to store and display the merchandises offered for sale. Such racks that are most of time disposed in island formation in the stores, basically comprise two or more vertical posts made of rigid metal, such as steel. Each post has a bottom end and a pair of front and rear surfaces formed with a plurality of vertical aligned apertures for use to detachably secure merchandise shelves through angular brackets in an overhanging fashion.

At least two and preferably more than two horizontal tie bars also made of metal, are used for rigidly interconnecting each pair of posts adjacent each other in spaced apart relationship.

The posts interconnected by the tie-bars are mounted onto the floor by means of transversal footings connected to their bottom ends and sized and positioned to hold the posts vertical even when shelves are secured thereto and loaded with merchandises to be displayed. Each footing is defined by at least one half-base having a vertical inner edge from which hooks projects, and a vertical outer edge. Each half-base is rigidly connectable to the post adjacent the bottom end thereof by insertion of its hooks into the apertures made in the front or rear surfaces of this post. When two half-bases are connected to one post, they horizontally projects away in opposite directions from the front and rear surfaces of the post and act as symmetrical stabilizers for holding this post vertical.

This basic structure is quite efficient. However, it calls for the manufacture of a plurality of structural members of different shape, namely the posts and the tie-bars which usually are of different structure depending on when they are intended to be positioned along the posts to interconnect the same. This in turn calls for different manufacturing processes (cold-forming, punching, welding . . .) which are sometimes difficult to carry out in line in a rational, time-and-cost efficient manner.

OBJECTS AND SUMMARY OF THE INVENTION

The object of the present invention is to make the manufacture of "gondolas" much easier to carry out in a time- and cost- efficient manner, by providing a structure wherein the posts and all the tie-bars are manufactured from only two pieces that can be produced by cold forming in a very fast, easy and continuous manner.

In accordance with a first and main aspect of the invention, a structural member is provided for use as a vertical supporting post in a merchandise display rack. This member is made of two pairs of identical pieces easy to produce by cold forming, namely:

- two identical, longitudinally extending end plates that are W-shaped in cross-section and oriented in such a manner as to face each other, and
- two identical, longitudinally extending side plates that are welded to the end plates to join the same and form this member.

Each of the end plates is made of one piece of heavy duty material and comprises:

- a first side wall portion projecting towards the other end plate;
- a second side wall portion extending parallel to the first side wall portion and projecting also towards the other end plate;
- first and second end wall portions integrally projecting at 90° from the first and second side wall portions, respectively, these first and second end wall portions extending flat in a same plane and projecting towards each other; and
- a U-shaped bridging portion integrally joining the first and second end wall portions, the U-shaped bridging portion having a bottom end wall extending parallel to the first and second end wall portions.

The first and second side wall portions are flat and sized to bear against and be welded to the side plates.

The first and second end wall portions are also flat and each provided with a row of longitudinally oriented slots of a given size, the slots of each of the first and second end wall portions being transversally aligned along the end plate.

The bottom end wall of the U-shaped briding portion is also flat and provided with a row of longitudinally oriented slots of another given size.

In accordance with another aspect of the invention, each of the side plates used for manufacturing the above mentioned structural member is preferably made of one piece of light duty material and is so formed as to define:

- a central portion that is large and flat; and
- a pair of side portions edging the central portion, each of the side portions having a U-shaped cross-section with a flat bottom extending in the same plane as the central portion, and a pair of inner and outer arms integrally projecting at 90° from the bottom in a direction opposite the adjacent end plate, the inner arm being folded back and joining the central portion.

In accordance with a further aspect of the invention, there is provided a merchandise display rack of the type described in the preamble of the present specification, wherein each of the vertical posts consists of a structural member made of two pairs of identical pieces, as defined hereinabove.

Advantageously, the horizontal tie-bars of the rack which interconnect the posts at the top and bottom ends thereof are made from the very same structural piece as the side-plates of the posts. As matter of fact, these tie-bars are of the same structure and width as the side-plates except that they have ends where the corresponding pair of side portions edging the central portion are cut out and the remaining central portion is bent at 90° and reinforced by longitudinal ribs punched therein.

The central portions that are so bent at 90°, act as hooks and are engageable into attaching means provided at the top and bottom ends of the posts.

One of these two tie-bars preferably has its central portions at both of its ends bent at 90° in the same direction as the inner and outer arms of its side portions, whereas the other tie-bar has its central portions at both of its ends bent at 90° in a direction opposite the inner and outer arms of its side portions.

The additional horizontal tie-bars that may be used for interconnecting said posts between the top and bottom ends thereof may similarly be made from the same structural piece as each side-plate and thus be of the very same structure as the side-plates, except that in this case both of the side portions edging the central portion are cut out over all of its length and the ends of the remaining central portion is bent at 90° and reinforced by longitudinal ribs punched thereon. Once again, the central portions that are bent at 90°, act as hooks and are engageable into other attaching means provided along the side plates of posts.

Thus, as may be understood, a substantial number of structural elements of the rack, namely the posts and tie-bars, are made from only two structural easy-to-produce pieces. This, of course, substantially reduces the manufacturing cost while providing a product that is structurally better than most of the existing racks presently available.

The invention and its advantages will be better understood upon reading the following non-limitative description of a preferred embodiment thereof, made with reference to the accompanying drawings.

DESCRIPTION OF A PREFERRED EMBODIMENT

Figure 1:
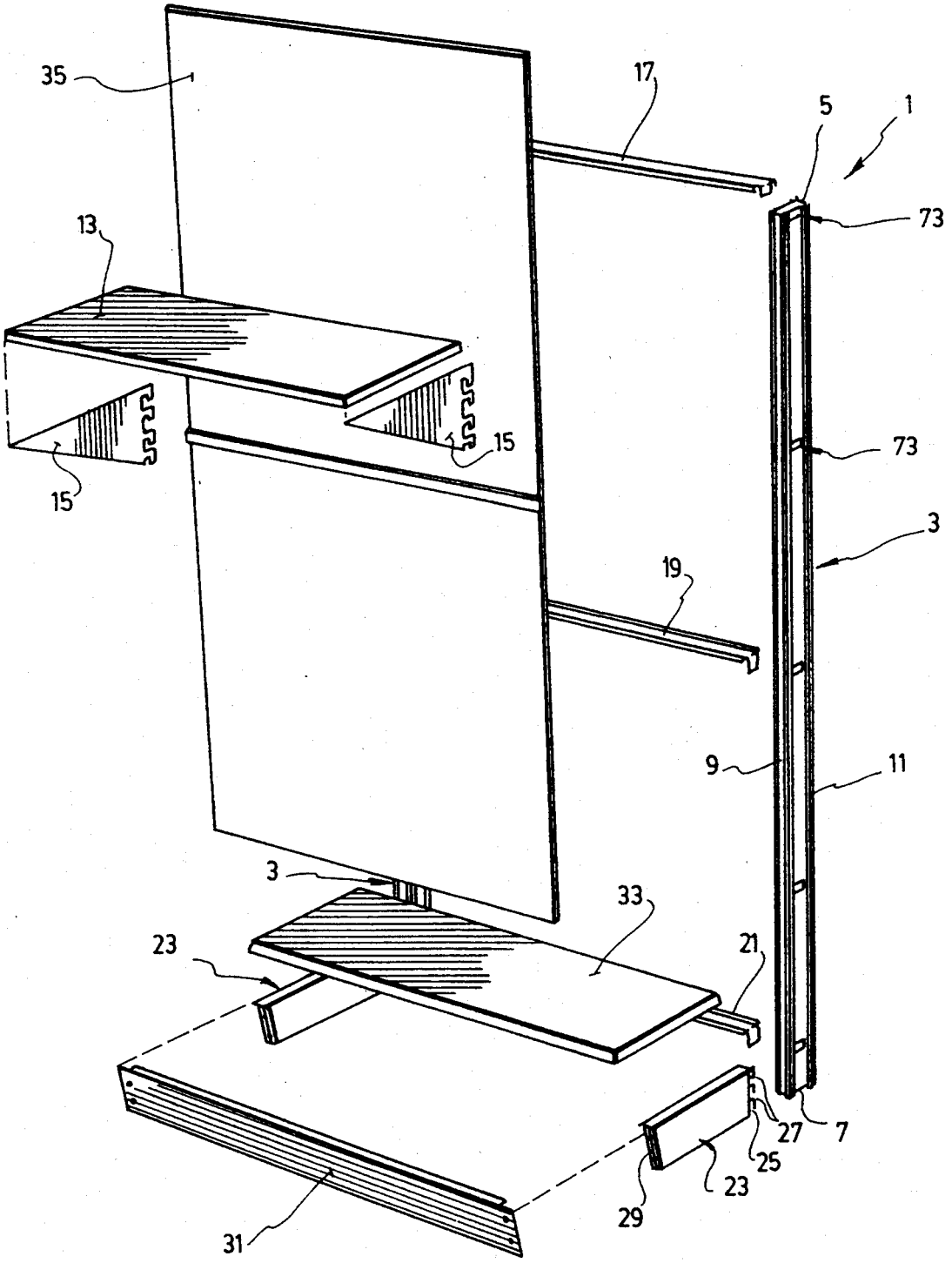
FIG. 1 is an exploded perspective view of a merchandise display rack made in accordance with the invention.

The merchandise display rack 1 according to the invention as shown in FIG. 1 of the drawings is of a rather conventional structure. It basically comprises two or more vertical posts 3, each having a top end 5, a bottom end 7 and a pair of front and rear surfaces 9, 11 formed with a plurality of vertically aligned apertures for use to detachably secure merchandise shelves 13 through angular brackets 15 in an overhanging fashion.

The rack 1 also comprises at least two and preferably more horizontal tie-bars 17, 19, 21 for rigidly interconnecting each group of two posts adjacent each other in spaced-apart relationship.

The rack 1 further comprises at least one half-base 23 per each post, each having a vertical inner edge 25 from which hooks 27 project and a vertical outer edge 29. The half-bases 27 are rigidly connectable by means of their hooks 27 to the front or rear surfaces 9, 11 of each post adjacent the bottom end 7 thereof, so as to define a transversal footing sized and positioned to hold the corresponding post 3 vertical even when shelves 13 are secured thereto and loaded with merchandises to be displayed.

The rack 1 may further comprise a kick plate 31 detachably connectable usually by means of hooks to the outer vertical edges 29 of two half-bases 23 that project away in the same direction from two posts 3 adjacent each other, and a bottom shelf 33 also detachably connectable to the same two half-bases 23 in such a manner as to bear on top of the same and of the kick plate connected thereto and extend across the rack.

The rack 1 may also comprise wooden panels 35 fixed to its posts 3 and tie-bars to "fill" the frame defined by these structural members whenever desired.

This basic structure is known per se and no invention is claimed therein.

As a matter of fact, the invention, in its broadest aspect, essentially lies in the way the posts are made from only two structural pieces easy to manufacture and assemble.

Figure 6:
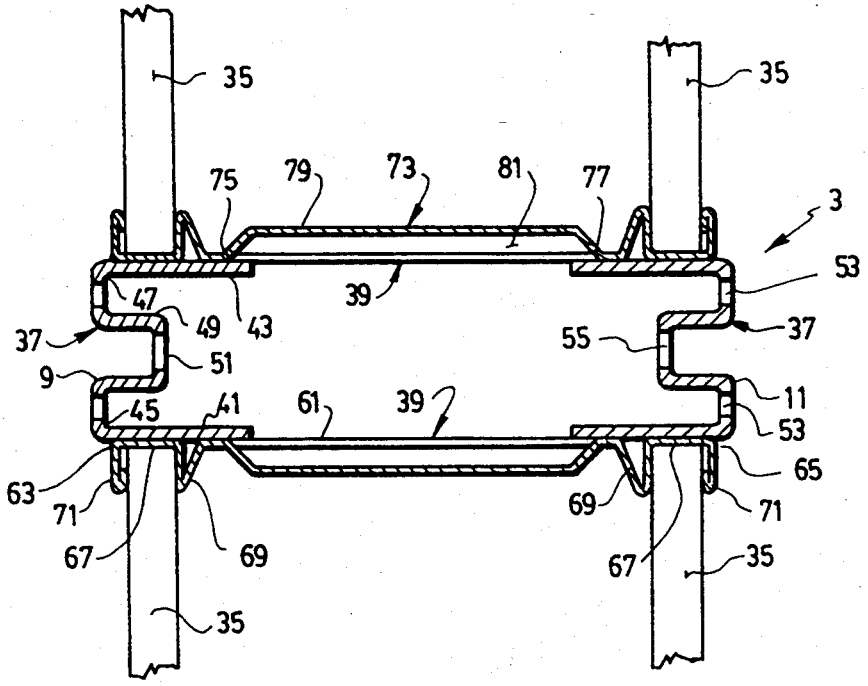
FIG. 6 is a cross-sectional view of one of the posts of the rack shown in FIG. 1.

As is clearly shown in FIG. 6, each of vertical posts 3 used in the rack 1 according to the invention consists of a structural member made of two identical, longitudinally extending end plates 37 that are W-shaped in cross-section and oriented in such a manner as to face each other and define the front and rear surfaces of the post, and of two identical, longitudinally extending side plates that are welded to the end plates 37 to join the same and form the required member which is then of generally rectangular shape.

Figure 3:
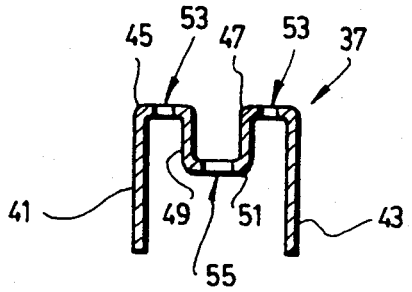
FIG. 3 is a top plan view of the end plate shown in FIG. 2.
Figure 2:
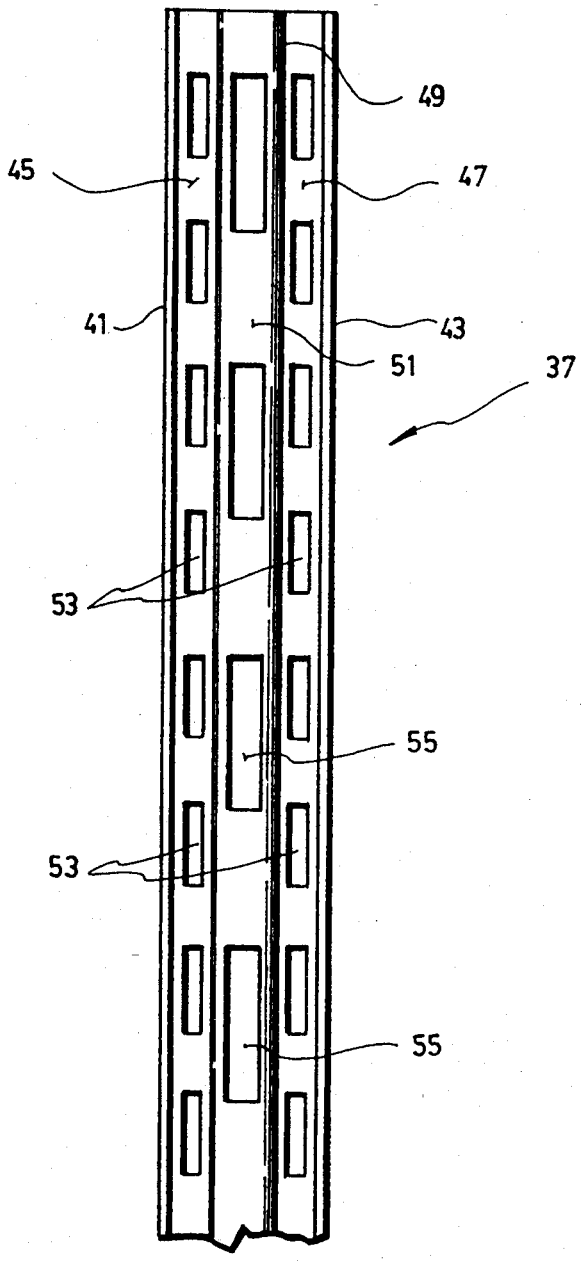
FIG. 2 is a rear elevational view of one of the end plates used for the manufacture of the posts of the rack of FIG. 1.

Referring now to FIGS. 2 and 3, each of the end plates 37 is advantageously made of one piece of heavy duty material, such as steel. This W-shaped piece that is preferably manufactured by cold forming, comprises:

- a first side wall portion 41 which, in use, is positioned so as to project towards the other end plate (see FIG. 6);
- a second side wall portion 43 which extends parallel to the first side wall portion and which, in use, is also positioned so as to project towards the other end plate;
- first and second end wall portions 45, 47 integrally projecting at 90° from the first and second side wall portions 41, 43, respectively, these first and second end wall portions 45, 47 extending flat in a same plane and projecting towards each other; and
- a U-shaped bridging portion 49 integrally joining the first and second end wall portions 45, 47, this U-shaped bridging portion having a bottom end wall 51 extending parallel to these first and second end wall portions.

As is better shown in FIG. 6, the first and second side wall portions 41, 43 are flat and sized to bear against and be welded to the side plates 39. The first and second end wall portions 45, 47 are also flat and each provided with a row of longitudinally oriented slots 53 of a given size. As is clearly shown in FIG. 2, the slots 53 of each of the first and second end wall portions 45, 47 are transversally aligned over the length of the end plate 37 and form the plurality of vertically aligned apertures mentioned hereinabove, for use to secure light merchandise shelves 13.

The bottom end wall 51 of the bridging portion 41 is also flat and provided with a third row of longitudinally oriented slots 55 of another given size, into which the hooks 25 of the half-base 23 or of a heavier shelf may rigidly be connected.

In practice, each end plate 37 may be about 1.125 inches wide and may have a bridging portion 49 that is about 0.313 inch wide and 0.375 inch deep. Each end plate may also be formed from a sheet of heavy duty steel in such a manner that its first and second side wall portions 41, 43 as well as its U-shaped bridging portion 49 are about 0.076 thick whereas its first and second end wall portions 5, 47 whose slots 53 are intended to receive and support the lighter shelves, are about 0.062 inch thick.

In such a case, the slots 53 may be 9/16"×5/32" large and spaced apart at a distance of, say, 7/16", whereas the slots 55 may be 11/16"×¼" large and spaced apart at a distance of, say, 15/16".

Figure 5:
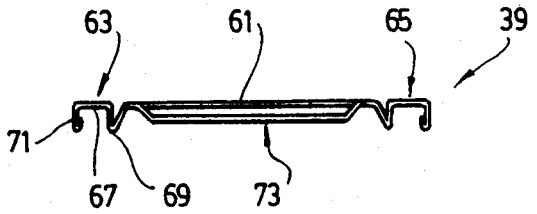
FIG. 5 is a top plan view of the side plate shown in FIG. 4.
Figure 4:
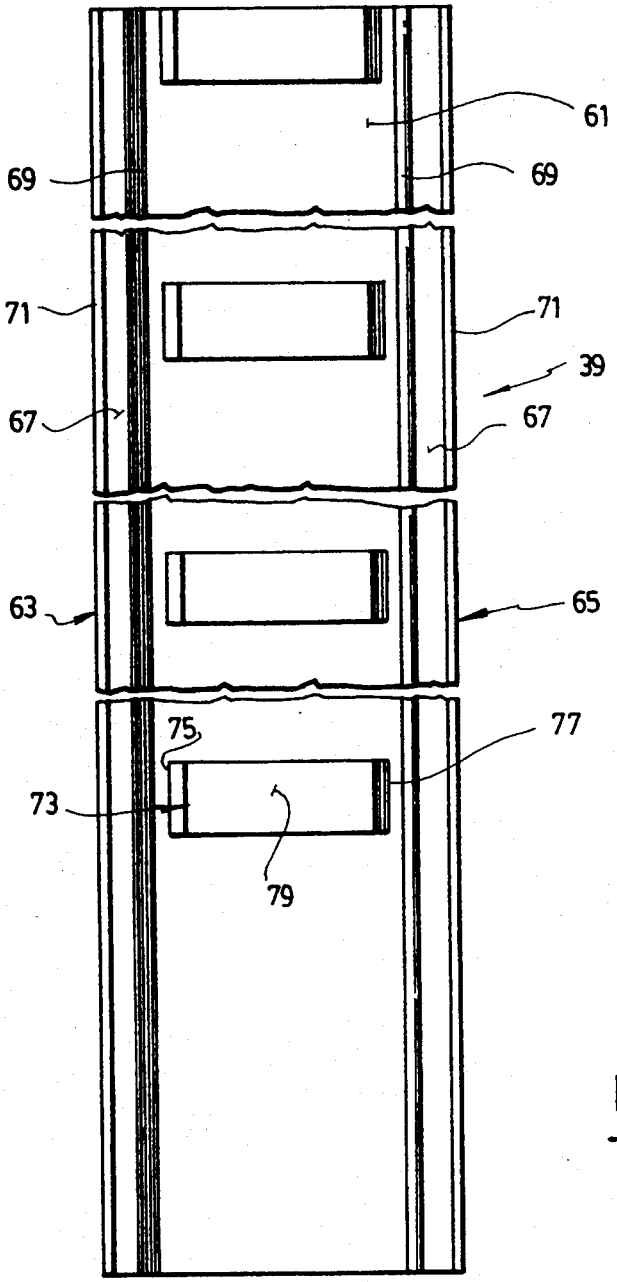
FIG. 4 is a side elevational view of one of the side plates used for the manufacture of the posts of the rack of FIG. 1.

Referring now to FIGS. 4 and 5, each of side plates 39 is made of one piece of light duty material, such as light steel. This piece which is also preferably manufactured by cold forming, comprises a central portion 61 that is large and flat and a pair of identical side portions 63, 65 edging the central portion. Each of the side portions 63, 65 has a U-shaped cross-section with a flat bottom 67 extending in the same plane as the central portion, and a pair of inner and outer arms 69, 71 integrally projecting at 90° from the flat bottom 67 in a direction opposite the adjacent end plate 37 (see FIG. 6). Of course, the inner arm 69 is folded back and joins the central portion 61 to form a unitary piece.

As may be understood, the U-shaped side portions 63, 65 of the side plate 39 substantially reinforce the same and give structural rigidity and strength to it.

In practice, each side plate 39 may be about 3.75 inches long and have side portions 63, 65 that are about 0.313 inch long and 0.437 inch deep. The thickness of the central portion 61 may be about 0.125 inch thick.

Advantageously, each of the side plates 39 also comprises attaching means 73 fixed at different heights along the central portion 71 to receive and attach the tie-bars 17, 19, 21. These attaching means 73 preferably consist of small rectangular plates of light duty material such as light steel, extending transversally to the central portion 61, each small plate having a pair of opposite edges 75, 77 bent at angle and fixed to the central portion 61 by welding, and a main surface 79 extending parallel to the central portion 61 at a short distance away from the same to define a flat hole 81 in which the end of a tie-bar may be attached by hooking.

It may be understood that the same kind of attachment means could be obtained by die cutting and punching the central portions 61 of the side plates 39, thereby avoiding the manufacture of small rectangular plates and the welding of the same onto these central portions.

In accordance with another aspect of the invention, all the tie-bars 17, 19, 21 used to interconnect the posts 3 are advantageously made from the same pieces of light steel as the side plates 39.

Figure 7:
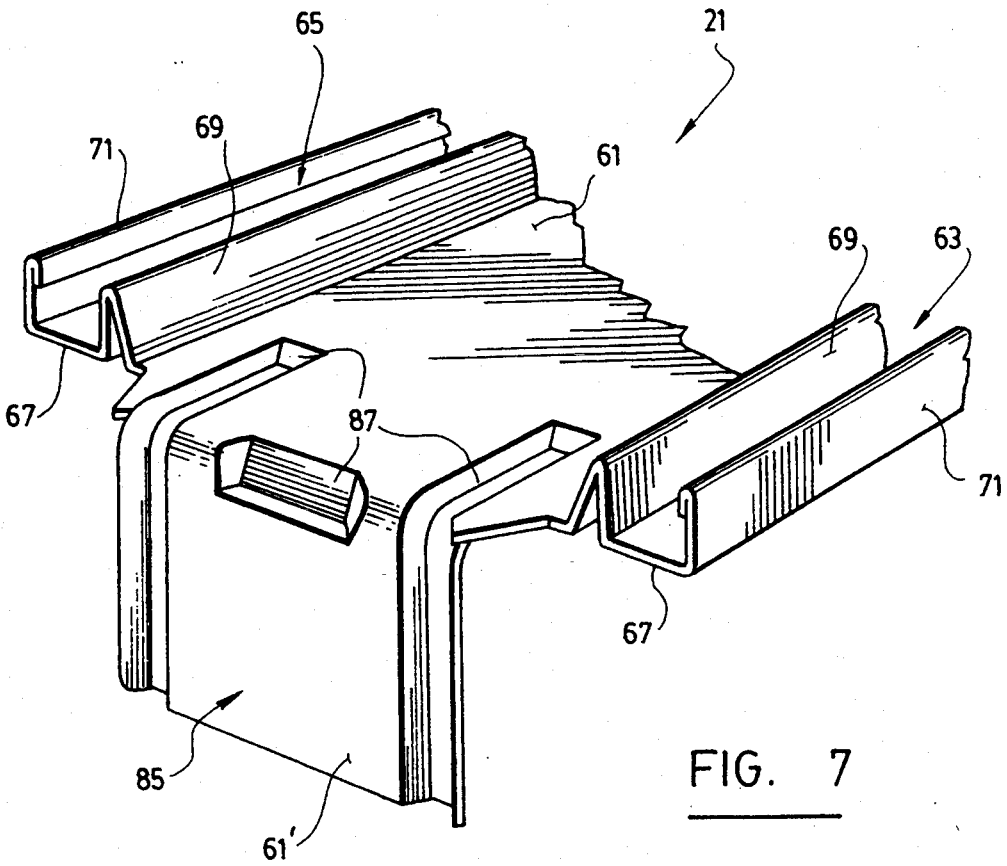
FIG. 7 is a perspective view of one end of the tie-bar interconnecting the posts of the rack shown in FIG. 1, at the bottom ends thereof.
Figure 8:
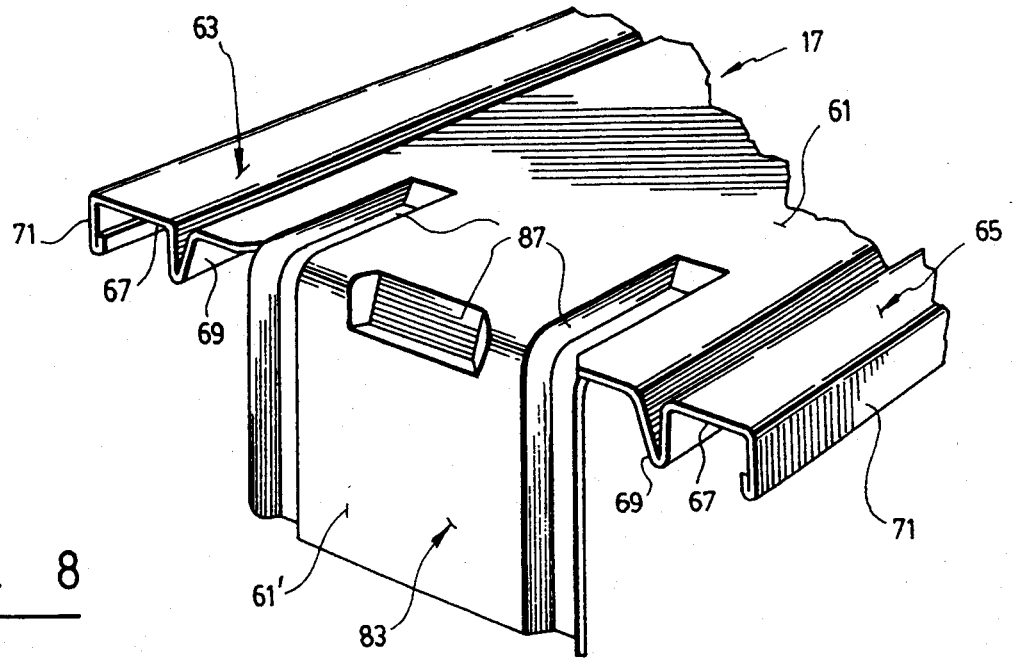
FIG. 8 is a perspective vide of one end of the tie-bar interconnecting the posts of the rack shown in FIG. 1, at the top ends thereof.

As is better shown in FIGS. 7 and 8, the horizontal tie-bars 17, 21 used for interconnecting the top and bottom ends 5, 7 of posts 3 are of the very same structure and width as the side-plates 39 except that they have ends 83, 85 where the corresponding pair of side portions 63, 65 edging the central portion 61 are cut out and the remaining central portion 61' is bent at 90° and reinforced by longitudinal ribs 87 punched therein. As can be inferred from FIG. 1, the central portions 61' bent at 90° act as hooks and are engageable into the flat holes 81 defined attaching means 73.

As is shown in FIG. 8, the upper tie-bar 17 has its central portions 61' at both of its ends bent at 90° in the same direction as the inner and outer arms 69, 71 of its side portions 63, 65. As is shown in FIG. 7, the lower tie-bar 21 has its central portions 61' at both of its ends bent at 90° in a direction opposite the inner and outer arms 69, 71 of its side portions 63, 65. The purpose of this particular orientation is to allow the side portions 63, 65 of the upper and lower tie-bars 17, 21 to engage the corresponding edges of the wood panel(s) 35 simultaneously with the side portions 63, 65 of the side plates 39 (see FIG. 6). In other words, the wooden panels 35 may be slidably fixed between the inner and outer arms 69, 71 of the side portions of the side plates 39 of the posts 3, and simultaneously between the inner and outer arms 69, 71 of the side portions of the upper ad lower tie-bars on one or both sides thereof, to "close" the rack 1 centrally, as all of these structural elements are made from the same piece and have the same width.

Figure 9:
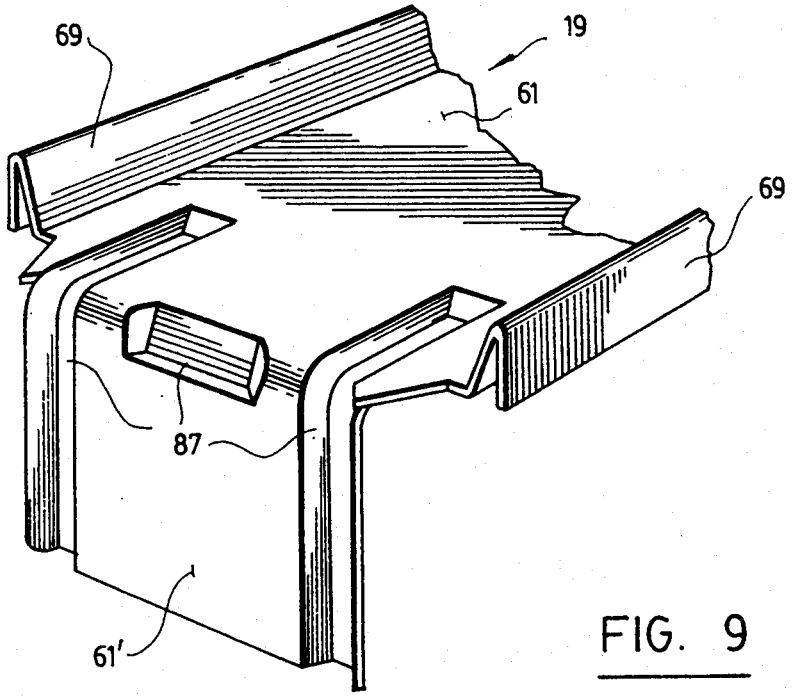
FIG. 9 is a perspective view of one end of the tie-bar interconnecting the posts of the rack shown in FIG. 1, at mid-height thereof.

The intermediary tie-bar(s) 19 must of course be smaller in width to extend between the wooden panels 35. For this reason, the tie-bar 19, as is better shown in FIG. 9, may be of the very same structure as the side plates 39, except that both of the side portions edging its central portion 61 are cut out over all of its length and the end 61' of the remaining central portion is bent at 90° and reinforced by longitudinal ribs punched 87 therein. Once again, the central portions 61' bent at 90° act as hooks and are engageable into the flat hole 81 of the attaching means 73.

Figure 10:
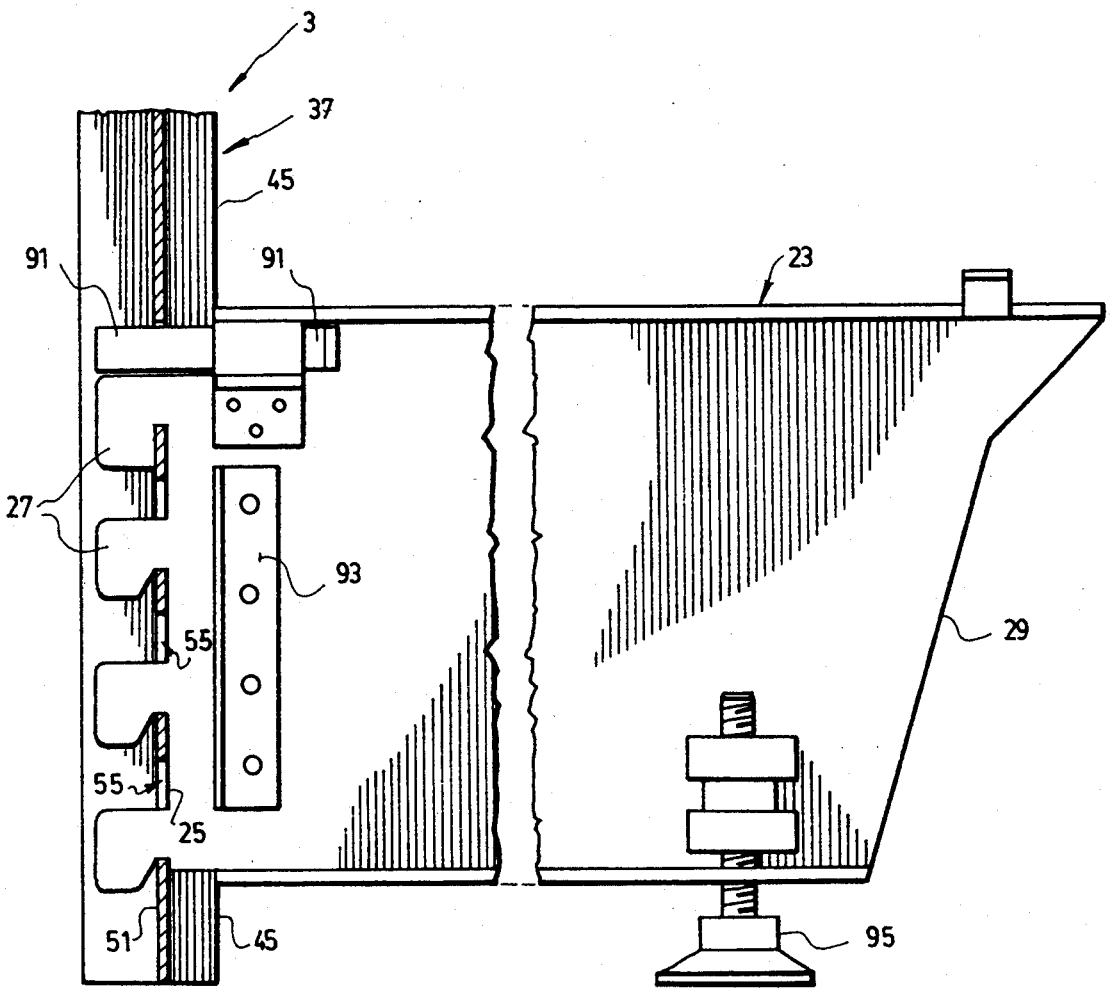
FIG. 10 is a side elevational view partially broken and in cross-section, of one of the half-bases connected to the bottom end of a post to keep it vertical.
Figure 11:
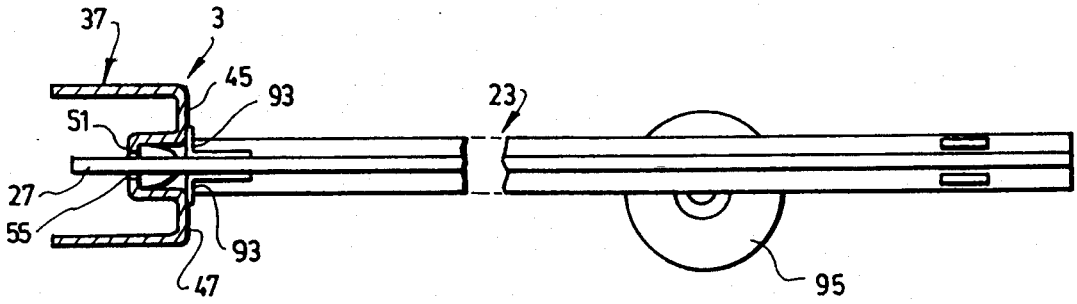
FIG. 11 is a top plan view partially in cross-section and partially broken of the half-base and post assembly show in FIG. 10.

Referring now to FIGS. 10 and 11, each half-base 23 is intended to be rigidly connected to a corresponding post 3 by longitudinal insertion of its hooks 27 into the slots 55 made in the bottom 51 of the bridging portion of the corresponding end plate 37, which, as aforesaid, is structurally very strong, and then by vertical sliding of the half-base down to ensure that its hooks 27 are fully engaged.

Advantageously, the half-base 23 may be provided with a locking pin 91 slidably mounted onto it adjacent the inner edge 25 thereof above one of the hooks 27. The locking pin 91 is movable into locking position inside the slot 55 of the corresponding post 3 in which the one hook 27 under the locking pin is inserted after the half-base 23 has been connected to the post 3, as is shown in FIG. 10, in order to prevent this half-base from moving up and out of the slots 55 and inadvertently sliding out of the post.

Each half-base 23 may also be provided with vertically extending, L-shaped bearing members 93 on both of its sides adjacent its inner edge 25, which comes into contact with the first and second end wall portions 45, 47 of the end plate 37 of the post 3, and helps in holding the half-base 23 in line with the post (see FIG. 11).

Each half-base 23 and optionally each post 3 may further be provided with height-adjustable levelers 95 comprising bolts fixed to the bottom end of each post 3 and adjacent the outer edge 29 of each half-base 23, to make each transversal footing adjustable.

Of course, obvious modifications could be made to the above structure without departing from the invention as defined in the appended claims.

We claim:

1. A structural member for use as a vertical supporting post in a merchandise display rack, said member being made of two identical, longitudinally extending end plates that are W-shaped in cross-section and oriented in such a manner as to face each other, and of two identical, longitudinally extending side plates that are welded to the end plates to join the same and form said member;

wherein each of said end plates is made of one piece of heavy duty material and comprises:

a first side wall portion projecting towards the other end plate;

a second side wall portion extending parallel to said first side wall portion and projecting also towards the other end plate;

first and second end wall portions integrally projecting at 90° from said first and second side wall portions, respectively, said first and second end wall portions extending fiat in a same plane and projecting towards each other; and a U-shaped bridging portion integrally joining said first and second end wall portions, said U-shaped bridging portion having a bottom end wall extending parallel to said first and second end wall portions.

said first and second side wall portions being fiat and sized to bear against and be welded to said side plates;

said first and second end wall portions being flat and each provided with a row of longitudinally oriented slots of a given size, the slots of each of said first and second end wall portions being transversally aligned along the end plate;

said bottom end wall being also fiat and provided with a row of longitudinally oriented slots of another given size and wherein each of said side plates is made of one piece of light duty material and comprises:

a central portion that is large and fiat: and a pair of side portions edging said central portion, each of said side portions having a U-shaped cross-section with a flat bottom extending in the same plane as said central portion, and a pair of inner and outer arms integrally projecting at 90° from said bottom in a direction opposite the adjacent end plate, said inner arm being folded back and joining said central portion.

2. The structural member of claim 1, wherein each of said side plate also comprises:

attaching means fixed at different heights along the central portion to receive and attach tie-bars.

3. The structural member of claim 2, wherein said attaching means consist of small plates of light duty material extending transversally to said central portion, each small plate having a pair of opposite edges bent at angle and fixed to said central portion and a main surface extending parallel to said central portion at a short distance away from the same, to allow attachment of one of said tie-bars by hooking.

4. The structural member of claim 3, wherein said end plates and side plates are made of steel.

5. The structural member of claim 4, wherein:

each end plate is about 1.125 inches wide;

the bridging portion of each end plate is about 0.313 inch wide and 0.375 inch deep;

the first and second side wall portions as well as the U-shaped bridging portion of each end plate are about 0.076 thick;

the first and second end wall portions of each end plate are about 0.062 inch thick;

each side plate is about 3.75 inches long;

the side portions of each side plate are about 0.313 inch long and 0.437 inch deep; and the central portion of each side plate is about 0.125 inch thick.

6. A merchandise display rack of the type comprising:

at least two vertical posts, each post having a bottom end and a pair of front and rear surfaces formed with a plurality of vertically aligned apertures for use to detachably secure merchandise shelves through angular brackets in an overhanging fashion;

at least two horizontal tie bars per each group of two of said posts adjacent each other for rigidly interconnecting said posts in spaced-apart relationship; and at least one half-base per each post, each having a vertical inner edge from which hooks project and a vertical outer edge, said at least one half-base being rigidly connectable by means of said hooks to the front or rear surfaces of each post adjacent the bottom end thereof, said half-bases whenever connected to one of said posts, so as to define transversal footing sized and positioned to hold said one post vertical even when shelves are secured thereto and loaded with merchandises to be displayed, wherein:

each of said at least two vertical posts consists of a structural member made of two identical, longitudinally extending end plates that are W-shaped in cross-section and oriented in such a manner as to face each other and define said front and rear surfaces of the post, and of two identical, longitudinally extending side plates that are welded to the end plates to join the same and form said member;

each of said end plates being made of one piece of heavy duty material and comprising:

a first side wall portion projecting towards the other end plate;

a second side wall portion extending parallel to said first side wall portion and projecting also towards the other end plate;

first and second end wall portions integrally projecting at 90° from said first and second side wall portions, respectively, said first and second end wall portions extending flat in a same plane and projecting towards each other; and a U-shaped bridging portion integrally joining said first and second end wall portions, said U-shaped bridging portion having a bottom end wall extending parallel to said first and second end wall portions;

said first and second side wall portions being flat and sized to bear against and be welded to said side plates;

said first and second end wall portions being flat and each provided with a row of longitudinally oriented slots of a given size, the slots of each of said first and second end wall portions being transversally aligned along the end plate and forming said plurality of vertically aligned apertures for use to secure said merchandise shelves, said bottom end wall being also flat and provided with a row of longitudinally oriented slots of another given size into which the hooks of one of said half-bases may be rigidly connected.

7. The display rack of claim 6, wherein each of said side plates is made of one piece of light duty material and comprises:

a central portion that is large and flat; and a pair of side portions edging said central portion, each of said side portions having a U-shaped cross-section with a flat bottom extending in the same plane as said central portion, and a pair of inner and outer arms integrally projecting at 90 ©from said bottom in a direction opposite the adjacent end plate, said inner arm being folded back and joining said central portion.

8. The display rack of claim 7, wherein each of said side plates also comprises:

attaching means fixed at different heights along the central portion to receive and attach tie-bars, said attaching means consisting of small plates of light duty material extending transversally to said central portion, each small plate having a pair of opposite edges bent at an angle and fixed to said central portion and a main surface extending parallel to said central portion at a short distance away from the same, to allow attachment of one of said tie-bars by hooking.

9. The display rack of claim 8, wherein:

said at least two horizontal tie-bars include a first tie-bar interconnecting said posts on top thereof and a second tie-bar interconnecting said posts at the bottom ends thereof; and, said first and second tie-bars are of the same structure and width as said side-plates except that they have ends where the corresponding pair of side portions edging the central portion are cut out and the remaining central portion is bent at 90° and reinforced by longitudinal ribs, said central portions bent at 90° acting as hooks and being engageable into said attaching means;

said first tie-bar having its central portions at both of its ends bent at 90° in the same direction as the inner and outer arms of its side portions, whereas the second tie-bar has its central portions at both of its ends bent at 90° in a direction opposite the inner and outer arms of its side portions.

10. The display rack of claim 9, wherein:

said at least two horizontal tie-bars also include at least one further tie-bar interconnecting said posts between the tops and bottom ends thereof, and said at least one further tie-bar is of the very same structure as said side plates, except that both of the side portions edging the central portion are cut out over all of its length and the ends of the remaining central portion is bent at 90° and reinforced by longitudinal ribs punched therein, said central portions bent at 90° acting as hooks and being engageable into said attaching means.

11. The display rack of claim 10, wherein said end plates, said side plates and said tie-rods are made of steel

12. The display rack of claim 11, further comprising:

a kick plate detachably connectable to the outer vertical edges of each group of two of said half-bases projecting away in the same direction from two of said posts adjacent each other; and a bottom shelf detachably connectable to each of said groups of two of said half-bases, in such a manner as to bear on top of said half-bases and kick plate connected thereto and extend across said half-bases.

13. The display rack of claim 12, further comprising:

wooden panels slidably fixed between the inner and outer arms of the side portions of the side plates of the posts, and between the inner and outer arms of the side portions of the first and second tie-bars on at least one side thereof, to "close" said rack centrally.

14. The improved rack of claim 11, further comprising:

height-adjustable levelers comprising bolts fixed to the bottom end of each post and adjacent the outer edge of each half-base, to make each transversal footing adjustable.

* * * * *